US008579467B1

(12) United States Patent
Szeto

(10) Patent No.: US 8,579,467 B1
(45) Date of Patent: Nov. 12, 2013

(54) LINEAR LED ARRAY HAVING A SPECIALIZED LIGHT DIFFUSING ELEMENT

(76) Inventor: Oliver Szeto, Bensalem, PA (US)

( * ) Notice: Subject to any disclaimer, the term of this patent is extended or adjusted under 35 U.S.C. 154(b) by 268 days.

(21) Appl. No.: 12/891,753

(22) Filed: Sep. 27, 2010

Related U.S. Application Data

(63) Continuation-in-part of application No. 12/244,795, filed on Oct. 3, 2008, now abandoned.

(60) Provisional application No. 61/000,639, filed on Oct. 29, 2007.

(51) Int. Cl.
*F21V 5/04* (2006.01)

(52) U.S. Cl.
USPC ..... 362/246; 362/311.14; 362/335

(58) Field of Classification Search
USPC ..... 362/246, 249.02, 311.01, 311.02, 362/311.03, 311.04, 311.09, 311.1, 311.14, 362/330, 335, 340
See application file for complete search history.

(56) References Cited

U.S. PATENT DOCUMENTS

| | | | | |
|---|---|---|---|---|
| 7,159,997 | B2 * | 1/2007 | Reo et al. | 362/335 |
| 7,213,936 | B2 * | 5/2007 | Wang et al. | 362/335 |
| 7,267,459 | B2 | 9/2007 | Matheson | |
| 7,467,876 | B2 * | 12/2008 | Segawa | 362/246 |
| 7,609,450 | B2 * | 10/2009 | Niemuth | 359/599 |
| 8,152,320 | B2 * | 4/2012 | Goto | 362/311.02 |

* cited by examiner

*Primary Examiner* — Y My Quach Lee
(74) *Attorney, Agent, or Firm* — LaMorte & Associates, P.C.

(57) ABSTRACT

A lighting assembly where the light from multiple LEDs is blended to provide uniform lighting over a wide area without bright spots or interference anomalies. The assembly has a metal base that defines a channel. The channel has a bottom surface and opposing side walls. An array of LEDs is mounted on a circuit board. The circuit board is mounted to the bottom surface of the channel. A panel of light diffusing material is suspended over the LED array between the opposing side walls of the channel. The light diffusing material is configured to have lenticules that run parallel to the alignment of the LEDs. The lenticules vary between regions of the panel. Light emitted by the LED array passes through, and is diffused by, the lenticules. The result is a uniform patch of light that does not have bright areas or dark areas.

15 Claims, 4 Drawing Sheets

LINEAR LED ARRAY HAVING A SPECIALIZED LIGHT DIFFUSING ELEMENT

RELATED APPLICATIONS

This application is a continuation-in-part of U.S. patent application Ser. No. 12/244,795, filed Oct. 3, 2008, now abandoned which claims priority of provisional patent application No. 61/000,639, filed Oct. 29, 2007.

BACKGROUND OF THE INVENTION

1. Field of the Invention

In general, the present invention relates to arrays of LEDs that are used for general illumination purposes. More particularly, the present invention relates to LED arrays with diffuser elements that help blend light beams generated by the individual LEDs in the array.

2. Prior Art Description

Light emitting diodes (LEDs) are commercially available in a wide variety of sizes and colors. LEDs are used for many purposes, such as for producing television displays. However, one of the fastest growing uses of LEDs is for general illumination, where LED arrays are being used in place of incandescent light bulbs and fluorescent bulbs. LEDs use less power and last much longer than either incandescent bulbs or fluorescent bulbs. Accordingly, the use of an LED light source is preferable in many lighting applications.

Although LEDs have advantages, they also embody certain disadvantages. In order for LEDs to emit light comparable to an incandescent light bulb or a fluorescent light bulb, an array of LEDs must be used. In an array of LEDs, the LEDs are placed together as close as possible. The density of the LEDs in the array is primarily dictated by the size of the LEDs, the power requirements of the LEDs and the thermal cooling requirements of the LEDs.

The output of an LED is greatly affected by temperature. If an LED becomes too hot, its light output decreases dramatically. If very high power LEDs are used, the LED array may only contain a few individual LEDs. However, the LEDs may have to be spaced relatively far apart so that the heat generated by the individual LEDs can be adequately dissipated.

Florescent bulbs traditionally provide a long strip of bright light. When an LED array is created to replace a florescent light, high powered LEDs are often placed in a straight line. Depending upon the power of the LEDs used, the spacing between the LEDs along the line can be as far apart as an inch.

When high powered LEDs are so widely spaced, they tend to create their own independent beams of light. Consequently, the light under such an LED array is not uniform. Rather, if an LED array has ten linearly aligned lights, for example, the illuminated area under the LED array would tend to have ten bright spots. This effect is often undesirable and causes consumers to opt for traditional florescent lights rather than an LED array.

Some attempts have been made to diffuse light produced by linear arrays of LEDs. U.S. Pat. No. 7,267,459 to Matheson discloses a linear LED array. It is disclosed that the LEDs many be covered with a lenticular lens. However, no details of the lenticular lens are provided, such as orientation, lens density and the like. The use of a diffusing element, such as a lenticular lens diffuses light, however, it also has the adverse effect of reducing light intensity. Many traditional lenticular lenses can absorb or misdirect much of the light energy produced by an LED. Consequently, if traditional lenticular lenses are used, the LEDs must be far more powerful than they need be to produce a desired degree of illumination.

A need therefore exists for a system and method of diffusing the light emitted by an LED array so that light form the LEDs is diffused with a minimum of light energy absorption. This need is met by the present invention as described below.

SUMMARY OF THE INVENTION

The present invention is a lighting assembly where the light from multiple LEDs is blended to provide uniform lighting over a wide area without bright spots or interference anomalies. The assembly has a metal base that defines a channel. The channel has a bottom surface and opposing side walls. An array of LEDs is mounted on a circuit board. The circuit board is mounted to the bottom surface of the channel.

A panel of light diffusing material is suspended over the LED array between the opposing side walls of the channel. Light emitted by the LED array passes through, and is diffused by, the light diffusing material. The light diffusing material has rows of lenticules that run parallel to the linear arrangement of LEDs. The lenticules directly in a central region directly above the LEDs have greater light diffusing properties than the lenticules in the side regions on either side of the central region. The result is a light assembly that creates a uniform area of illumination without bright and dark areas.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention can be adapted to many different types of LED arrays, the present invention is particularly useful when used with a linear array. Accordingly, the present invention will be illustrated and described as part of a linear LED array in order to set forth the best mode contemplated for the invention.

Figure 1:
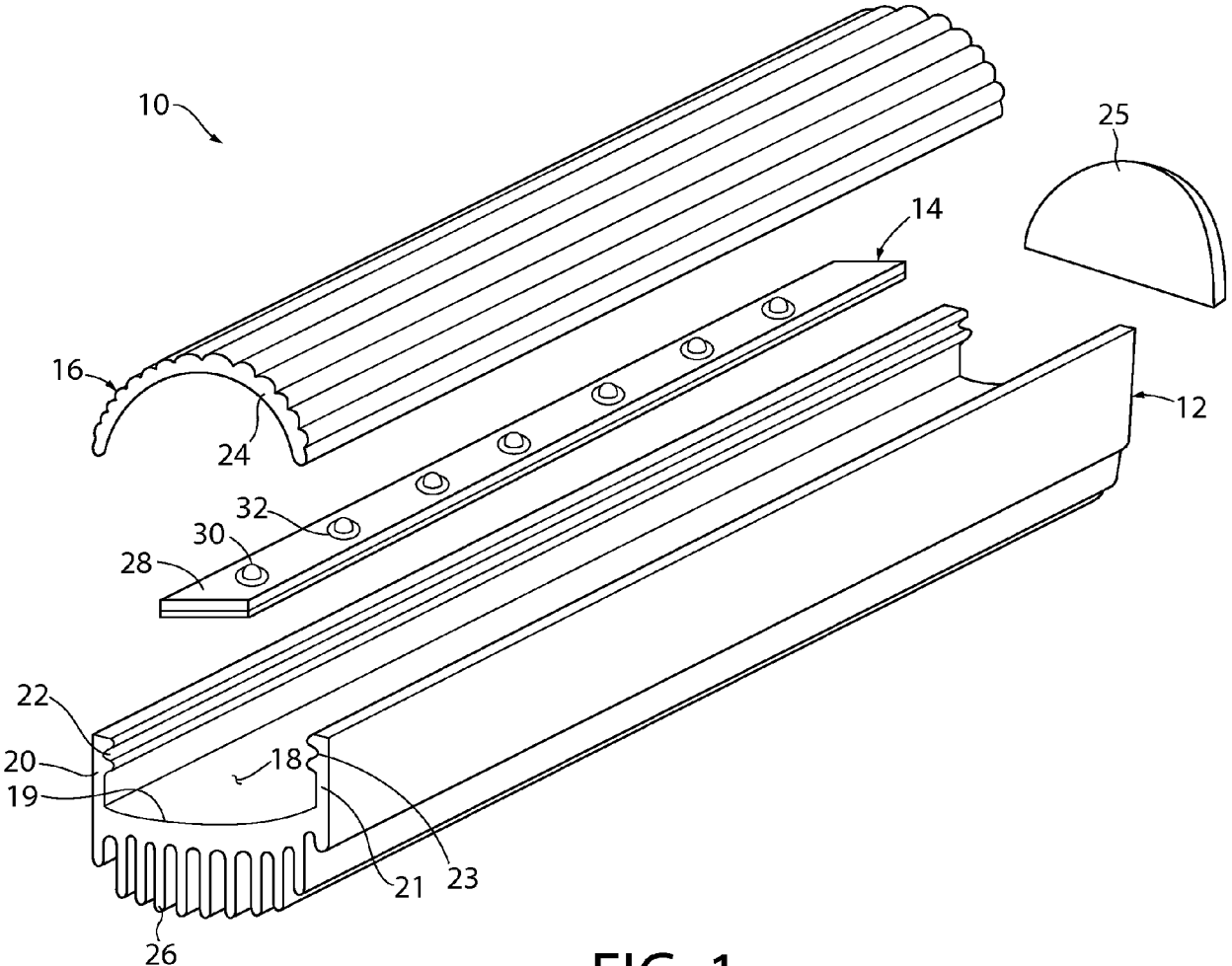
FIG. 1 is an exploded view of an exemplary embodiment of a light assembly.
Figure 2:
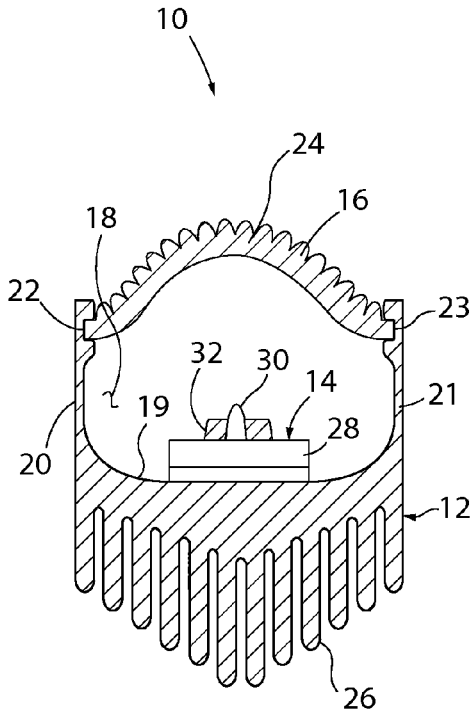
FIG. 2 is a cross-sectional view of the embodiment of FIG. 1.

Referring to FIG. 1 in conjunction with FIG. 2, there is shown an LED lighting assembly 10. The lighting assembly 10 has three primary components, which include a base housing 12, a lighting module 14 and a diffuser 16. The base housing 12 supports the lighting module 14 and conducts heat away from the lighting module 14. The diffuser 16 is held above the lighting module 14 and diffuses the light from the lighting module 14 without creating interference patterns in the passing light or over-absorbing light energy, as will be further explained.

The base housing 12 is preferably a metal structure and can be extruded from aluminum or an aluminum alloy. The base housing 12 defines a channel 18 along one side. The channel 18 has a bottom surface 19 and two vertical side walls 20, 21 that extend upwardly along the sides of the bottom surface 19. The side walls 20, 21 run the length of the base surface 19, therein creating the uniform channel 18 that runs the length of the bottom housing 12. The bottom surface 19 is preferably flat along its center so that the lighting module 14 can lay flush against the bottom surface 19. The open ends of the channel 18 are closed by detachable end caps 25.

Mounting grooves 22, 23 are formed along each of the opposing side walls 20, 21. The grooves 22, 23 on the opposing side walls 20, 21 face each other and are used to connect a curved panel 24 of light diffusing material to the LED lighting assembly 10.

Fins 26 are formed along the bottom of the base housing 12 under the channel 18. The fins 26 increase the surface area of the base housing 12 and enable the base housing 12 to serve as an efficient air cooled heat sink.

The lighting module 14 is comprised of a circuit board 28 containing a plurality of LEDs 30. The LEDs 30 are arranged in a straight line, with a preferred spacing of between one centimeter and three centimeters between each of the LEDs 30. Each LED 30 may optionally be placed within a reflector 32. The reflectors 32 reflect the light out away from the LEDs 30 in a diverging cone of between ten degrees and one hundred and twenty degrees.

The circuit board 28 holding the LEDs 30 and reflectors 32 is mechanically anchored to the center of the channel 18 in the base housing 12. A thermally conductive dielectric pad, or similar membrane, is placed under the circuit board 28 to prevent the circuit board 28 from electrically shorting against the base housing 12.

Once mounted to the base housing 12 within the channel 18, the lighting module 14 is partially encased on three sides by the bottom surface 19 and the two vertical side walls 20, 21 of the channel 18. The diffuser 16 is used to fully encase the lighting module 14 within the housing 12. The diffuser 16 is a panel 24 of light diffusing material that is defined along its periphery by two long edges 34, 35 and two short edges 36, 37. The long edges of the panel 24 are received by the grooves 22, 23 in the vertical side walls 20, 21 of the channel 18.

Figure 3:
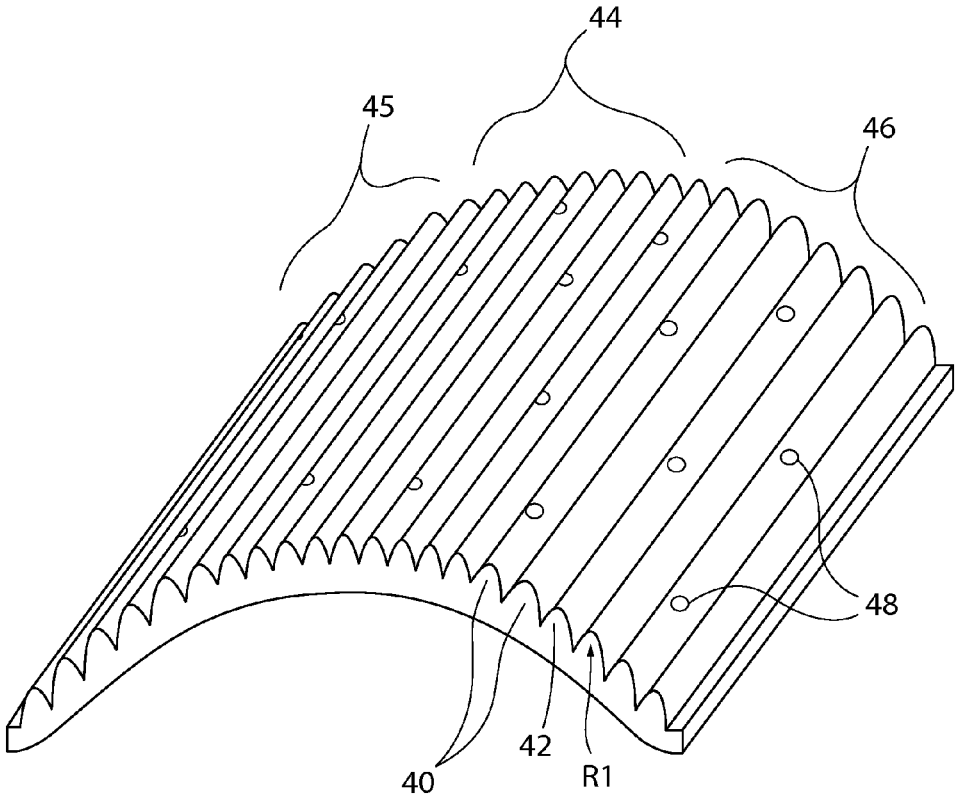
FIG. 3 is an cross-sectional view of the diffuser used in the light assembly.

The light diffusing material used as the diffuser 16 is a custom manufactured variation of a lenticular lens. Referring to FIG. 3 in conjunction with FIGS. 1 and 2, it will be understood that the diffuser 16 is not a traditional prior art lenticular lens. Rather, the diffuser 16 is custom manufactured to optimize its effectiveness in both passing and diffusing light in the present invention light assembly 10.

The diffuser 16 has parallel rows of lenticules 40, as do traditional lenticular lenses. However, the lenticules are not uniform across the face of the diffuser 16. In FIG. 3, the diffuser 16 has a variety of different lenticule types. Each row of lenticules 40 runs in the same parallel direction. The direction of the lenticules 40 is parallel to the linear direction of the LEDs 30 on the circuit board 28. Such an orientation is required to prevent the development of interference patterns in the light passing through the diffuser 16. Each of the rows of lenticules 40 has a lens structure 42 with a predetermined radius of curvature R1. The smaller the radius of curvature R1, the greater the optical effect and the wider the light diffusion angle created by the lenticules 40.

In FIG. 3 it will be understood that the central region 44 of the diffuser 16 is positioned directly above the LEDs 30 and will therefore receive the most direct light energy from the LEDs 30. The side regions 45, 46 of the diffuser 16 receive less direct light. In order to help reduce the light absorption characteristics of the diffuser 16 and to create a more uniform dispersion of light, the lenticules 40 in the central region 44 have a smaller radius of curvature than due the lenticules 40 in the side regions 45, 46. Since the lenticules 40 in the center region 44 have a smaller radius of curvature, they create a greater diffusion angle in the emitted light. The brightest light is therefore diffused the most. For the central region 44, it is preferred that the lenticules 40 have a diffusion angle of at least forty degrees. The density of the lenticules 40 in the center region 44 is preferably between forty lines per inch and one hundred lines per inch.

Even within the central region 44, the lenticules 40 may have a varying radius of curvature. The lenticules 40 in the dead center of the central region may have a slightly greater diffusion angle than those off-center. The changes in diffusion angle are preferably proportional to the offset of the lenticules 40. In this manner, the changes in the radii of curvature and diffusion angles are a linear progression from the center of the diffuser 16 to the side edges of the diffuser 16.

In the side regions 45, 46 of the diffuser 16, the diffusion angle of the lenticules 40 decrease below thirty degrees. Since the lenticules 40 in the side regions 45, 46 of the diffuser create a smaller diffusion angle, the lenticules 40 in the side regions 45, 46 pass more light and therefore absorb less light energy. The overall diffuser 16, therefore, becomes more light efficient and more uniform. Furthermore, since the lenticules 40 in the different areas of the diffuser 16 diffuse light at different angles, there is no fixed frequency in the overlapping light patterns. This acts to reduce interference patterns and dark spots that are inherent in uniform prior art lenticular lenses.

The diffuser 16 is preferably curved. The radius of curvature embodied by the diffuser 16 causes the light from the LEDs 30 to impinge upon the interior of the diffuser 16 evenly. This further ensures that the light passing through the diffuser 16 has an even brightness.

To further increase the light transmission efficiency of the diffuser 16, pinholes 48 can be formed throughout the diffuser 16. The pinholes 48 preferably have a diameter of three millimeters or less. The density of the pinholes 48 is preferably between ten holes per square centimeter and one-hundred holes per square centimeter. With pinholes 48 of this small diameter, light diffuses as it passes through the pinholes 48, therein preventing small bright spots in the illumination pattern. The presence pinholes 48 can increase the brightness of the illuminated area by ten percent or more.

Figure 4:
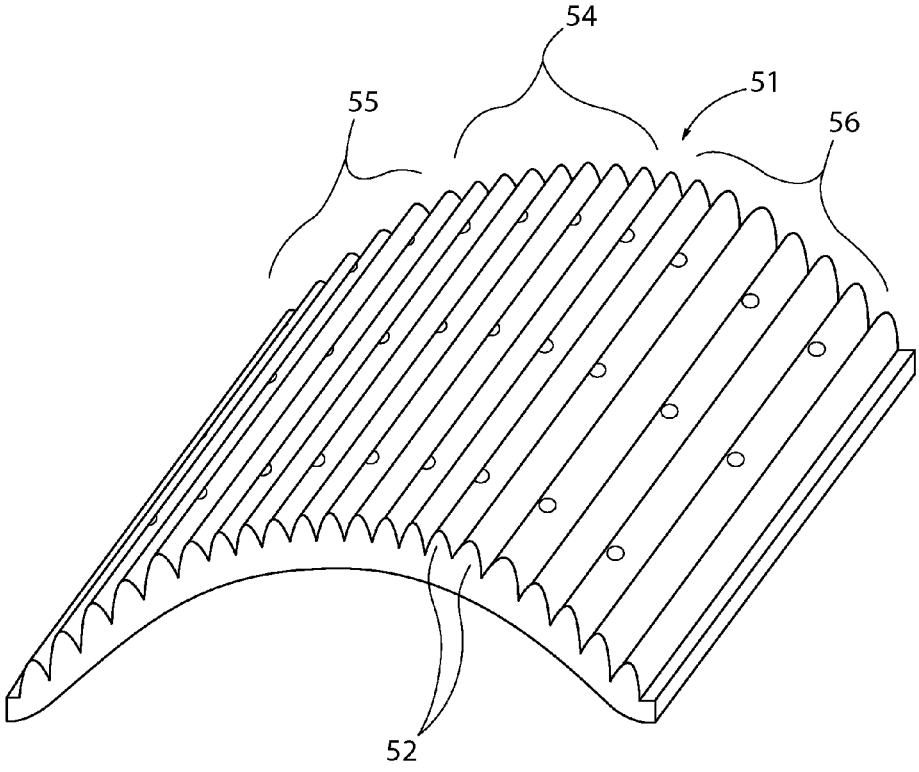
FIG. 4 is a cross-sectional view of an alternate embodiment of the diffuser.

In certain outdoor or high humidity applications, the presence of pinholes 48 in the diffuser can produce problems with water vapor and condensation. Referring to FIG. 4, an alternate embodiment of the diffuser is shown. In the embodiment of FIG. 4, there are no pinholes. Rather, smooth areas 50 of plastic are provided that contain no lenticules. The smooth areas 50 pass nearly as mush light as do open pinholes. Furthermore, by keeping the smooth areas 50 under one millimeter in diameter, light diffuses as it passes through the smooth areas and no bright spots appear.

In the embodiment of FIG. 4, all the lenticules 52 have the same radius of curvature and diffusion characteristics. However, the density of the lenticules 53 varies across the face of the diffuser 16. The density of the lenticules 53 is greatest in the central region 54 of the diffuser 51. This area of the diffuser 16 receives the most light and therefore requires the most diffusion of light. Conversely, the density in the side regions 55, 56 of the diffuser are less dense since there is a lesser degree of light passing through such areas.

In all the embodiments of the diffusers illustrated and described, the central region of the diffuser diffuses light more than the side regions of the diffuser. Furthermore, all the lenticules run parallel to the linear alignment of the LEDs. Such features of the diffuser ensure that the individual spots of light created by the individual LEDs are bended along the length of the linear array. The LEDS when viewed through the diffuser therefore do not look like individual LEDs but rather provide light evenly along the entire line in the same manner as a continuous fluorescent tube bulb. Furthermore, although the LEDs are far thinner in a line that is the diffuser, the varied diffusion characteristics of the diffuser ensure that the diffuser passes a uniform light intensity that does not have bright lines or bright spots. This too enables the light assembly to mimic the illumination characteristics of a traditional florescent tube bulb.

It will be understood that the embodiments of the present invention that are illustrated and described are merely exemplary and that a person skilled in the art can make many variations to those embodiments using functionally equivalent components. All such variations, modifications and alternate embodiments are intended to be included within the scope of the present invention.

What is claimed is:

1. A lighting assembly, comprising:

a metal base defining a channel having a bottom surface and opposing side walls, wherein grooves are formed in said side walls;

a plurality of LEDs mounted in a straight line on a circuit board, wherein said circuit board is mounted to said bottom surface of said channel; and a curved diffuser having two parallel long edges and an apex in a central region between said long edges, wherein said long edges are retained by said grooves in said side walls channel, said apex positioning above said plurality of LEDs;

wherein curved diffuser has rows of lenticules that run in parallel to said straight line of said plurality of LEDs; and wherein said rows of lenticules each embody diffusion angles that decrease from said apex to said side edges.

2. The assembly according to claim 1, wherein said rows of lenticules have diffusion angles that decrease in a linear progression from said apex to said side edges.

3. The assembly according to claim 1, wherein said rows of lenticules proximate said apex have a higher density of lenticular elements than do said rows of lenticules in said side edges.

4. The assembly according to claim 1, further including a plurality of holes formed through said diffuser.

5. The assembly according to claim 4, wherein each of said plurality of holes has a diameter of less than three millimeters.

6. The assembly according to claim 4, wherein said plurality of holes have a pattern density of between ten and one hundred holes per square centimeter.

7. The assembly according to claim 1, further including a plurality of flat areas disposed among said rows of lenticules.

8. The assembly according to claim 1, wherein each of said flat areas has a diameter no greater than three millimeters.

9. The assembly according to claim 1, further including reflectors for reflecting light from said LEDs toward said diffuser.

10. The assembly according to claim 1, wherein each of said LEDs generates a beam of light, wherein each beam of light overlaps at another beam of light by at least twenty percent before said beam of light passes through said diffuser.

11. A lighting assembly, comprising:

a base defining a channel having a bottom surface and opposing side walls;

a plurality of LEDs arranged in a single straight line on a circuit board, wherein said circuit board is mounted to said bottom surface of said base;

a curved lenticular panel that curves between two parallel long side edges forming an apex in a central region between said long side edges, said curved lenticular panel being suspended over said channel between said opposing side walls, wherein said lenticular panel has parallel rows of lenticules that run parallel to said straight line of said plurality of LEDs, wherein said rows of lenticules aligned above said plurality of LEDs have greater light diffusion characteristics than do said rows of lenticules proximate said side edges of said lenticular panel.

12. The assembly according to claim 11, wherein at least some of said rows of lenticules within said central region embody a higher diffusion angle than at least some of said rows of lenticules proximate said side regions.

13. The assembly according to claim 11, further including a plurality of holes formed through said lenticular panel.

14. The assembly according to claim 13, wherein each of said plurality of holes has a diameter of less than one millimeter.

15. The assembly according to claim 13, further including a plurality of flat areas disposed among said lenticules.

* * * * *